US008536972B2

(12) United States Patent
Hofsaess

(10) Patent No.: US 8,536,972 B2
(45) Date of Patent: Sep. 17, 2013

(54) TEMPERATURE-DEPENDENT SWITCH

(76) Inventor: Marcel P. Hofsaess, Sondershausen (DE)

( * ) Notice: Subject to any disclaimer, the term of this patent is extended or adjusted under 35 U.S.C. 154(b) by 277 days.

(21) Appl. No.: 12/861,134

(22) Filed: Aug. 23, 2010

(65) Prior Publication Data

US 2011/0050385 A1 Mar. 3, 2011

(30) Foreign Application Priority Data

Aug. 27, 2009 (DE) ..... 10 2009 039 948

(51) Int. Cl.
*H01H 37/52* (2006.01)
*H01H 37/04* (2006.01)

(52) U.S. Cl.
USPC ..... 337/381; 337/380

(58) Field of Classification Search
USPC ..... 337/97, 112, 113, 298, 380, 381; 29/622
See application file for complete search history.

(56) References Cited

U.S. PATENT DOCUMENTS

| | | | | | |
|---|---|---|---|---|---|
| 2,707,738 | A | * | 5/1955 | Weissheimer et al. | 337/368 |
| 2,907,851 | A | * | 10/1959 | Moorhead et al. | 337/377 |
| 3,414,225 | A | * | 12/1968 | Lester | 248/506 |
| 4,027,385 | A | * | 6/1977 | Deubel | 29/622 |
| 4,297,668 | A | * | 10/1981 | Place | 337/365 |
| 4,446,450 | A | * | 5/1984 | Boulanger et al. | 337/380 |
| 4,446,451 | A | * | 5/1984 | Boulanger | 337/380 |
| 4,467,385 | A | * | 8/1984 | Bandoli et al. | 361/24 |
| 4,626,821 | A | * | 12/1986 | Versaw | 337/380 |
| 4,641,121 | A | * | 2/1987 | Boulanger | 337/380 |
| 4,795,997 | A | | 1/1989 | Fisher et al. | |
| 4,887,063 | A | * | 12/1989 | Hofsass | 337/380 |
| 5,011,101 | A | * | 4/1991 | Buchser | 248/27.3 |
| 5,126,510 | A | * | 6/1992 | Bauer et al. | 174/547 |
| 5,307,543 | A | * | 5/1994 | Krillenberger | 24/543 |
| D365,804 | S | * | 1/1996 | Klaus | D13/178 |
| 5,670,930 | A | * | 9/1997 | Hofsass et al. | 337/380 |
| 5,699,033 | A | * | 12/1997 | Hofsass | 337/380 |
| 5,723,922 | A | * | 3/1998 | Fowlkes | 310/68 C |

(Continued)

FOREIGN PATENT DOCUMENTS

| | | |
|---|---|---|
| DE | 1 590 966 | 12/1966 |
| DE | 21 21 802 | 1/1973 |

(Continued)

*Primary Examiner* — Anatoly Vortman
(74) *Attorney, Agent, or Firm* — Harness, Dickey & Pierce, P.L.C.

(57) ABSTRACT

A temperature-dependent switch 10 has, on the outside on its housing, a first and at least a second connecting surface 22, 23 for directly connecting feed lines and, in the housing, a temperature-dependent switching mechanism, which depending on its temperature produces or opens an electrically conducting connection between the two connecting surfaces 22, 23. The feed lines are directly connected, at their inner ends 27, 28, to the connecting surfaces 22, 23, the switch 10 being encased by an insulating protective layer 32, and the feed lines, at their free ends 29, 31 which are remote from the inner ends 27, 28, are free of the protective layer 32. The feed lines are in the form of connecting lugs 25, 26, which are connected in material-connecting engagement, at their inner ends 27, 28, to the connecting surfaces 22, 23 and, at their free ends 29, 31, are directly forms as plug-type connections. The insulating protective layer 32 is configured such that it brings about a structurally stable connection between the housing, the connecting surfaces 22, 23 and the inner ends 27, 28 of the connecting lugs 25, 26.

11 Claims, 3 Drawing Sheets

(56) References Cited

U.S. PATENT DOCUMENTS

| | | | | | |
|---|---|---|---|---|---|
| 5,745,022 | A | * | 4/1998 | Becher et al. | 337/104 |
| 5,828,285 | A | * | 10/1998 | Hofsass | 337/112 |
| 5,828,286 | A | * | 10/1998 | Hofsass | 337/343 |
| 5,864,278 | A | | 1/1999 | Becher | |
| 5,864,279 | A | * | 1/1999 | Becher et al. | 337/380 |
| 5,877,671 | A | * | 3/1999 | Hofsass | 337/343 |
| 5,892,429 | A | * | 4/1999 | Hofsass | 337/377 |
| 5,903,418 | A | * | 5/1999 | Boivin et al. | 361/22 |
| 5,942,967 | A | * | 8/1999 | Grimes | 337/380 |
| 5,973,587 | A | * | 10/1999 | Hofsass | 337/377 |
| 6,031,447 | A | * | 2/2000 | Hofsass | 337/377 |
| 6,064,295 | A | * | 5/2000 | Becher et al. | 337/349 |
| 6,091,316 | A | * | 7/2000 | Hofsass | 337/377 |
| 6,097,274 | A | * | 8/2000 | Hofsass | 337/362 |
| 6,100,784 | A | * | 8/2000 | Hofsass | 337/343 |
| 6,133,817 | A | * | 10/2000 | Hofsass et al. | 337/377 |
| 6,154,117 | A | * | 11/2000 | Sato et al. | 337/365 |
| 6,181,233 | B1 | * | 1/2001 | Hofsass et al. | 337/377 |
| 6,191,680 | B1 | * | 2/2001 | Hofsass | 337/362 |
| 6,249,210 | B1 | * | 6/2001 | Hofsass | 337/324 |
| 6,249,211 | B1 | * | 6/2001 | Hofsaess | 337/377 |
| 6,300,860 | B1 | * | 10/2001 | Hofsass | 337/377 |
| 6,302,361 | B1 | * | 10/2001 | Schaefer et al. | 248/27.3 |
| D450,045 | S | * | 11/2001 | Yang | D13/184 |
| 6,417,758 | B1 | * | 7/2002 | Russell et al. | 337/380 |
| 6,448,883 | B1 | * | 9/2002 | Hofsass | 337/373 |
| 6,507,267 | B2 | * | 1/2003 | Russell et al. | 337/380 |
| 6,583,710 | B2 | * | 6/2003 | Hayashi et al. | 337/343 |
| 6,724,293 | B1 | * | 4/2004 | Hofsass | 337/365 |
| 6,781,504 | B2 | * | 8/2004 | Scott et al. | 337/380 |
| 7,345,571 | B2 | * | 3/2008 | Mizuno | 337/381 |
| 7,622,835 | B2 | * | 11/2009 | Kimball et al. | 310/68 C |
| 7,626,484 | B2 | * | 12/2009 | Scott et al. | 337/343 |
| 7,663,467 | B2 | * | 2/2010 | Hsu | 337/336 |
| 7,839,259 | B2 | * | 11/2010 | Takeda et al. | 337/380 |
| 2002/0055298 | A1 | | 5/2002 | Becher et al. | |

FOREIGN PATENT DOCUMENTS

| | | | | |
|---|---|---|---|---|
| DE | 24 42 397 | | | 3/1976 |
| DE | 26 44 411 | A1 | | 4/1978 |
| DE | 80 28 913 | U1 | | 2/1981 |
| DE | 3733693 | A1 | * | 5/1988 |
| DE | 91 02 841.8 | U1 | | 5/1992 |
| DE | 92 14 543.4 | U1 | | 2/1993 |
| DE | 92 14 544.2 | U1 | | 2/1993 |
| DE | 41 39 091 | C2 | | 8/1993 |
| DE | 195 45 996 | A1 | | 9/1996 |
| DE | 196 09 310 | A1 | | 9/1997 |
| DE | 196 23 570 | A1 | | 1/1998 |
| DE | 197 05 411 | A1 | | 8/1998 |
| DE | 197 08 436 | A1 | | 9/1998 |
| DE | 198 16 807 | A1 | | 10/1999 |
| DE | 103 01 803 | A1 | | 7/2004 |
| DE | 10 2005 001 371 | A1 | | 7/2006 |
| GB | 1 394 612 | | | 5/1975 |
| WO | WO 02/086927 | A1 | | 10/2002 |

* cited by examiner

TEMPERATURE-DEPENDENT SWITCH

CROSS-REFERENCE TO RELATED APPLICATIONS

The present application claims priority to German National Application No. 10 2009 039 948.8 filed Aug. 27, 2009. The entire contents of the priority application are incorporated herein by reference.

BACKGROUND OF THE INVENTION

The present invention relates to a temperature-dependent switch which comprises on the outside of its housing a first and at least a second connecting surface for directly connecting feed lines and, in the housing, a temperature-dependent switching mechanism, which, depending on its temperature, closes or opens an electrically conducting connection between the two connecting surfaces, wherein feed lines at their inner ends are directly connected to the connecting surfaces, the switch being encased by an insulating protective layer and the feed lines, at their free ends which are remote from the inner ends, being free from the protective layer.

Such a temperature-dependent switch is known from DE 41 39 091 C2.

Such temperature-dependent switches are frequently known from the prior art. They are used for protecting electrical appliances, such as hairdryers, motors for lye pumps, irons etc. from overheating and/or from an excessively high current.

For this purpose, the known temperature-dependent switches are connected to appliance to be protected such that they are arranged electrically in series with the appliance in the supply circuit thereof, with the result that the operating current of the appliance to be protected flows through the temperature-dependent switch. In addition, the switch is fitted to the appliance to be protected in such a way that it is brought to the same temperature as the appliance to be protected.

The known temperature-dependent switches comprise a temperature-dependent switching mechanism, which opens or closes an electrical connection depending on its temperature between two connecting surfaces provided on the outside on the housing of the switch. For this purpose, as a rule, a bimetallic part is provided in the switching mechanism, said bimetallic part being deformed suddenly from its low-temperature position into its high-temperature position when its switching temperature is reached, thereby, as a rule, lifting a movable contact part off from a fixed contact part.

The fixed contact part is connected to one of the two connecting surfaces, while the movable contact part interacts with the second connecting surface, either via the bimetallic part or a snap-action-disc or -spring associated with the bimetallic part.

Designs are also known in which the bimetallic part carries a contact bridge, which produces, directly, an electrical connection between two connecting surfaces.

Examples of such temperature-dependent switches are disclosed in DE 21 21 802 A, DE 26 44 411 A, DE 196 23 570, DE 103 01 803, DE 92 14 543 U, DE 91 02 841 U, DE 197 05 441 A1, DE 195 45 996 A1 or DE 10 205 001 371 A1 and other industrial property rights held by the applicant, such that reference may be made to these industrial property rights for further details.

When using the known switches, it is necessary to ensure, inter alia, that the switches are electrically insulated from the electrical appliance to be protected, such that undesirable short circuits do not occur.

Namely, the known switches often have an electrically conducting housing lower part, which is in the form of a pot and houses the temperature-dependent switching mechanism. The electrically conducting housing lower part is closed off by a likewise electrically conducting cover part, which is fixed on the housing lower part with an insulating film interposed. The first connecting surface is provided on the cover part, while the second connecting surface is provided on the base, the side wall or that edge of the housing lower part which holds the cover part.

Feed lines, generally either flexible connecting strand wires or rigid connecting lugs, are now galvanically or directly connected, generally connected by material-connecting engagement, i.e. usually soldered or welded, to these two connecting surfaces, the strand wires or connecting lugs then being used for the further wiring of the known temperature-dependent switches.

The switches which are prefabricated and provided with strand wires or connecting lugs in this way are then provided with a cap in order to insulate the switches electrically from the outside. If the switches have been provided with connecting lugs, the caps have corresponding slots, through which the connecting lugs need to be threaded when the cap is plugged onto the switch, which is not only correspondingly time-consuming and laborious, but always also involves the risk of the galvanic connection between the connecting lugs and the connecting surfaces being damaged or of the connecting lugs being bent, with the result that said connecting lugs are not suitable for subsequent automatic installation in the electrical appliances to be protected, but need to be further-processed.

If, on the other hand, the feed lines are in the form of strand wires, the switches are provided with so-called shrink-fit caps, which are sealed at one end, with the result that, once the shrink-fit caps have been plugged onto the switches which have been prefabricated with the strand wires, the strand wires protrude out of the shrink-fit cap at the other end. The shrink-fit caps are then shrunk onto the switch.

In the case of the switch known from DE 41 39 091 C2, which was mentioned at the outset, the feed lines are in the form of relatively rigid metal sheets, which are riveted, with their inner limbs, to the connecting surfaces. Then, in one embodiment, the switch with the riveted joints and the inner ends is encapsulated by injection moulding with a low-pressure epoxy resin in a low-pressure process at a tool temperature of from 150 to 180° C. The free ends of the metal sheets which are remote from the inner ends in this case remain free of epoxy resin. Once the epoxy resin has cured, connecting strand wires are soldered to the free ends of the metal sheets and the free ends are then bent over the inner ends.

By virtue of the riveting and the encapsulation by injection moulding with the thermosetting plastic, the intention is to ensure a fixed connection which is capable of permanently withstanding the mechanical loads between the metal sheets and the housing of the switch on which the connecting surfaces are formed. The encapsulation by injection moulding in this case also ensures good electrical insulation and sealing of the riveted joints, with the result that it is not possible for any dirt such as dust or liquids to enter the housing.

With the known switch, however, one disadvantage is that the riveting of the metal sheets is time-consuming and involves the risk of the housing being deformed during the riveting process. As a result of the extremely small dimensions of the temperature-dependent switches, however, it is possible for very small deformations of the housing to result in the switch no longer closing and/or opening reliably.

In addition, the known switch has a complex design and is complex to assemble owing to the additional metal sheets provided between the housing and strand wires. In order to connect each connecting strand wire, a riveting operation and, subsequently, a soldering operation and, thereupon, a bending operation are required.

Finally, the known switch can be used only to a restricted extent, since it does not provide any possibilities for a plug-type connection. The connecting strand wires used in the known switch still need to be soldered to the appliance to be protected, which is time-consuming and involves the risk of an insufficient "cold" soldered joint.

A connection technique with plug-type connections is demanded, however, by a large number of processors of the known temperature-dependent switches precisely because switches with such connections are fitted to the appliance to be protected simply, quickly and primarily reliably, to which a contribution is also made by the matching dimensions and interspaces in the plug-type connections, on the one hand, and the respective applications, on the other hand.

As has already been mentioned at the outset, it is already known to provide temperature-dependent switches directly with plug-type connections, which can be connected to the appliance to be protected by being screwed, by suitable clamping techniques or by being plugged on, for example. Owing to the complicated connection between the plug-type connections and the housing of the respective temperature-dependent switch and the required insulating caps or encapsulating housings, these switches are also complex to assemble and have the abovementioned disadvantages.

One particular disadvantage here is that the caps or encapsulating housings either have a very complicated design or else the fitting of the cap to the switch which has already been provided with connecting lugs is complex and therefore cannot be automated.

Such a temperature-dependent switch with soldered or welded plug-type connections is known from DE 92 14 544 U1.

DE 80 28 913 U1 discloses a temperature-dependent switch inserted into a two-part insolating housing made from thermoplastic material. The two housing parts are connected to one another by ultra sonic welding. This document explicitly mentions that a protective layer made from sintered epoxy resin is neither mechanically nor thermally stable and tends to crack especially under high pressure.

SUMMARY OF THE INVENTION

In view of the above, one object of the present invention is to provide a temperature-dependent switch of the type mentioned at the outset with plug-type connections which can be assembled easily.

In the temperature-dependent switch mentioned at the outset, this and other objects are achieved according to the invention by the fact that the feed lines are in the form of connecting lugs which are connected at their inner ends in material-connecting engagement to the connecting surfaces and, at their free ends, are directly formed as plug-type connections, and that the insulating protective layer is configured such that it brings about a structurally stable connection between the housing, the connecting surfaces and the inner ends of the connecting lugs.

The objects underlying the invention are thus achieved in its entirety.

The inventor of the present application has recognized that it is nevertheless possible, contrary to the previous opinion in the prior art, to galvanically connect in material-connecting engagement, i.e. to solder or weld, connecting lugs formed as plug-type connections to a temperature-dependent switch, without there being the risk of the material-connecting engagement starting to get cracks when the switch is subsequently plugged onto the respective application. That is to say that it has been found that, by virtue of the switch, the connecting surfaces and the inner ends of the connecting lugs being jointly encased or enveloped by the protective layer, a structurally stable connection is produced which can subsequently be subjected to sufficiently high mechanical loads without the quality of the galvanic or direct connection being impaired.

The riveting used in the prior art, with all of the associated disadvantages, is not necessary as far as the inventor is aware for ensuring the sufficiently structurally stable connection between the connecting surfaces and the connecting lugs if, according to the invention, the insulating protective layer encases the housing and the inner ends of the connecting lugs.

A further advantage is based on the fact that, by virtue of this encasing process, not only the stability of the galvanic connection in material-connected engagement is ensured, but that, at the same time, the required electrical insulation and protection against the ingress of dirt is ensured, with the result that it is possible to dispense with shrink-fit caps, encapsulating housings and other protective caps.

The solution according to the invention, thus, is contrary to the explicit teaching of document DE 80 28 913 U1 mentioned above.

According to one object, the inner ends are soldered to the connecting surfaces.

It is advantageous here that the material-connecting engagement can be produced easily, safely and quickly.

According to a further object, the insulating protective layer is a sintered protective layer.

The inventor of the present application has determined that a sintered protective layer results in a particularly stable structure which ensures a very good mechanical stability of the casing.

According to a still further object, the insulating protective layer contains a thermosetting plastic, preferably an epoxy resin.

It is advantageous here that sintered protective layers with a thermosetting plastic can be produced particularly easily and provide permanent protection against the ingress of dirt and moisture, but also at the same time ensure good mechanical stability.

It is generally preferred if the temperature-dependent switching mechanism comprises a bimetallic part, the bimetallic part preferably being arranged electrically in series between the connecting surfaces when the switch is in the closed state, further preferably, the temperature-dependent switching mechanism comprises a spring part which in one embodiment is arranged electrically in series between the connecting surfaces when the switch is in the closed state. Alternatively, the switching mechanism can comprise a contact bridge, which is carried by the bimetallic part or the spring part and is arranged electrically in series between the connecting when the switch is in the closed state.

These are the preferred designs of temperature-dependent switches.

In the context of the present invention, a bimetallic part is understood to mean a multilayered, active, sheet-like component part comprising two, three or four components with different coefficients of expansion which are connected to one another non-detachably. The connection of the individual layers of metals or metal alloys is a material-connecting engagement or a form-fitting connection and is achieved by rollers, for example.

In this case, the bimetallic part is generally in the form of a spring which is clamped in at one end or in the form of a loosely inserted disc.

If the bimetallic part is in the form of a bimetallic spring tongue, as in DE 198 16 807 A1, said bimetallic part bears, at its free end, a movable contact part, which interacts with a fixed contact part. The fixed contact part is electrically connected to a first external connection, with a second external connection being electrically connected to the clamped-in end of the bimetallic spring tongue.

When being below its response temperature, the bimetallic spring tongue closes the electrical circuit between the two external connections by pressing the movable contact part against the fixed contact part.

If the temperature of the bimetallic spring tongue increases, said bimetallic spring tongue begins to stretch and to be deformed in a creep phase until, finally, it jumps over into its open position, in which it lifts the movable contact part off from the fixed contact part.

If, on the other hand, the bimetallic part is configured as a bimetallic disc, said bimetallic disc generally interacts with a spring snap-action disc, which carries the movable contact part, which interacts with the fixed contact part in the above-described way. The spring snap-action disc is supported with its edge on an electrode, which is connected to the second external connection. Such a switch is described, for example, in DE 21 21 802 A or DE 196 09 310 A1.

Below its response temperature, the bimetallic disc is inserted loosely, i.e. is not subjected to any mechanical loads. The contact pressure between the fixed and the movable contact parts and therefore the electrical connection between the two external connections is provided via the spring snap-action disc. If the temperature of the known temperature-dependent switch increases, the bimetallic disc passes through a creep phase, in which it is gradually deformed until it then suddenly jumps over into its open position, in which it acts on the spring snap-action disc in such a way that it lifts the movable contact part off from the fixed contact part and therefore opens the known switch.

In the above-described switch with the bimetallic spring tongue, the bimetallic part itself is current-carrying, with the result that it is heated by the current flowing through the switch. In this way, the known switch not only responds to external temperature increases, but also responds to an excessively high current flow.

Such switches therefore have a temperature-dependent and current-dependent response.

In contrast to this, in the case of the switch with a bimetallic disc, the bimetallic part is always current-free, i.e. is not heated by the flowing current, with the result that such switches operate largely independently of current.

However, switches are also known in which a bimetallic spring tongue interacts with a spring snap-action part, which conducts the flowing current, with the result that, with these designs, the bimetallic spring tongue itself does not conduct any current. Conversely, switches are also known in which a bimetallic disc carries the movable contact part and therefore has current flowing through it.

Finally, temperature-dependent switches are known which have two external connections, which are each connected to a fixed contact part, an electrically conductive contact bridge being provided which conducts the flowing current if said contact bridge rests against the fixed contact parts.

Such switches with a contact bridge are described, for example, in DE 197 08 436 A1. These are provided for applications in which high rated currents flow through the switch, which high rated currents would result in a current-carrying spring snap-action part or bimetallic part being subjected to severe loads or intrinsic heating.

In this case, the contact bridge is carried by a spring snap-action disc, which interacts with a bimetallic disc. If the bimetallic disc is below its response temperature, it is positioned freely in the switch, without any mechanical loading, and the spring snap-action disc presses the contact bridge against the fixed contact parts, with the result that the circuit is closed. If the temperature is increased, the bimetallic disc snaps over from its force-free closed position into its open position, in which it operates against the spring snap-action disc and lifts the contact bridge off from the fixed contact parts.

In addition, the invention relates to a process for manufacturing a temperature-dependent switch, comprising the steps:

providing a temperature-dependent switch which has, on the outside on its housing, a first and at least a second connecting surface for directly connecting feed lines and, in the housing, a temperature-dependent switching mechanism, which, depending on its temperature, produces or opens an electrically conducting connection between the two connecting surfaces, providing connecting lugs, which each have an inner end for connection to the connecting surfaces and, at their free end which is remote from the inner end, are each formed as a plug-type connection, directly connecting the inner ends of the connecting lugs to the connecting surfaces, and encasing the switch with an insulating protective layer in such a way that the connecting lugs, at their free ends, are free of the protective layer.

According to one object, in step c), the inner ends of the connecting lugs are soldered to the connecting surfaces.

The associated advantages consist in the amount of time saved and the quality of the galvanic connection.

According to a further object, in step c), the connecting lugs are stamped out on a strip, thereafter the switches are supplied and are soldered, with their connecting surfaces, to the inner ends of the respective connecting lugs, which are still located on the strip.

In the case of this measure, it is advantageous that a completely automated manufacture not only of the temperature-dependent switches but also of the switches which are completely provided with feed lines and are encased by the protective layer and are therefore protected is possible.

If the connecting lugs are stamped out on the strip, i.e. from a continuous sheet-metal strip, they may also need to be bent vertically at their free ends in order to "fit" with respect to the connecting surfaces on the switch which may be vertically offset with respect to one another. The switches are then supplied on a separate strip and are aligned with respect to the connecting lugs still located on the strip in such a way that the inner ends of the connecting lugs come to lie on the connecting surfaces, where they are then automatically soldered.

According to a still further object, it is generally preferred if, in step d), the protective layer is produced by means of liquid-phase sintering.

It is advantageous here that a mechanically stable protective layer can be produced in a simple manner even in the case of a temperature-dependent switch without the switch which is sensitive per se to the ingress of liquids being impaired in terms of its function.

According to another object, in step d), the switches which are soldered to the connecting lugs are immersed in at least one bath with a sintering epoxy solution, preferably the switches, which are still located on the strip, are passed through the at least one bath with the sintering epoxy solution.

It is advantageous here that the enveloping process with the protective layer is performed easily, quickly and reliably and the encasing operation can be performed with the switches still located on the strip, which entails considerable advantages primarily as regards production costs and production times, in comparison with DE 41 39 091 A1, mentioned at the outset.

Liquid-phase sintering with a thermosetting plastic is known per se from a large number of documents from the prior art, and corresponding components are commercially available.

According to a further object, in step d), the switches which are still located on the strip are passed through at least two baths with sintering epoxy solution, wherein, further preferably, in step d), the switches which are passed through a bath with sintering epoxy solution are each passed through a continuous furnace.

This results in a stable, fixed protective layer comprising at least two sintered layers, the protective layer overall being capable of withstanding very high mechanical loads.

Further advantages result from the description and the attached drawing.

It goes without saying that the features mentioned above and the features yet to be explained below can be used not only in the respectively given combinations, but also in other combinations or on their own, without departing from the scope of the present invention.

BRIEF DESCRIPTION OF THE DRAWINGS

One embodiment of the invention is illustrated in the drawing and will be explained in more detail in the description below. In the drawing:

FIG. 2 shows a perspective view at an angle from above of a temperature-dependent switch with connecting lugs soldered on;

DESCRIPTION OF A PREFERRED EMBODIMENT

Figure 1:
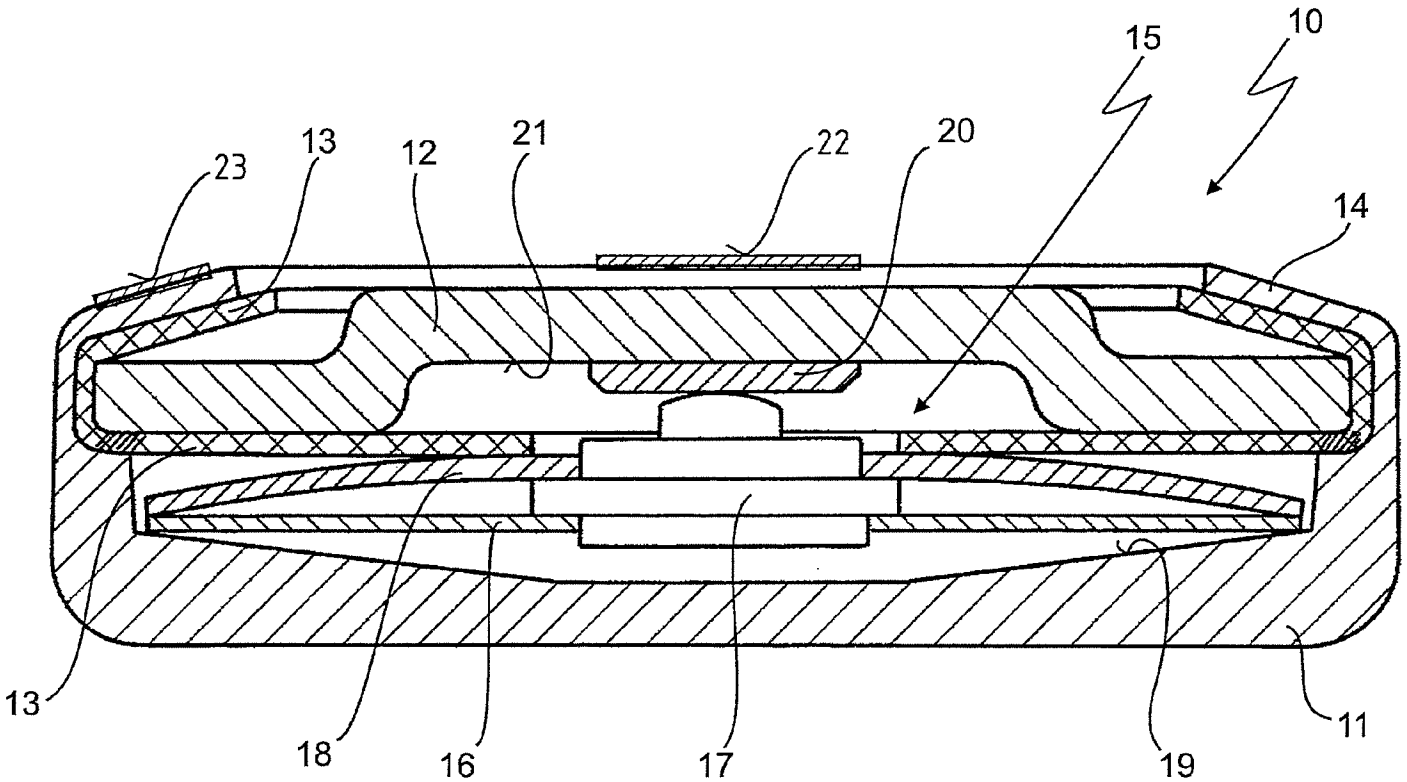
FIG. 1 shows a schematic, sectioned cross-sectional illustration of an embodiment of a temperature-dependent switch, which can be used in accordance with the invention.

In FIG. 1, 10 denotes a temperature-dependent switch, which comprises a pot-like lower part 11, which is closed by a cover part 12, which is held on the housing lower part 11 by a flanged edge 14 with an insulating film 13 interposed.

A temperature-dependent switching mechanism 15, which comprises a spring snap-action disc 16 which carries, centrally, a movable contact part 17, on which a freely inserted bimetallic disc 18 rests, is arranged in the housing of the switch 10, said housing being formed by the lower part 11 and the cover part 12.

The spring snap-action disc 16 is supported on a base 19 internally on the lower part 11, which is manufactured from an electrically conducting material.

The movable contact part 17 is in bearing contact with a fixed contact part 20, which has been provided on an inner side 21 of the cover part 12, which is likewise manufactured from metal.

In this way, the temperature-dependent switching mechanism 15 produces, in the low-temperature position shown in FIG. 1, an electrically conducting connection between the cover part 12 and the lower part 11, with the operating current flowing via the fixed contact part 20, the movable contact part 17 and the spring snap-action disc 16.

Alternatively, it is also possible to use directly a bimetallic part instead of the spring snap-action disc 18, said bimetallic part carrying the movable contact part 17 and therefore conducting the operating current when the switch 10 is closed.

In addition, it is possible to arrange the two connecting surfaces 22, 23 next to one another on the cover part 12 and to provide the switching mechanism 15 with a contact bridge, which is carried by the bimetallic part or the spring part and is arranged electrically in series between the connecting surfaces 22, 23 when the switch 10 is in the closed state.

It is therefore irrelevant for the advantages according to the invention whether the switch 10 is designed as in FIG. 1 or is designed as is disclosed in the documents cited above, the content of said documents hereby being incorporated by reference into the subject matter of the present application.

If, in the case of the switch 10 shown in FIG. 1, the temperature of the bimetallic disc 18 is increased beyond its response temperature, said bimetallic disc 18 snaps over from the convex position shown in FIG. 1 into its concave position, in which it lifts the movable contact part 17 off from the fixed contact part 20, counter to the force of the spring disc 16, and therefore opens the circuit.

Such a temperature-dependent switch 10 is known, for example, from DE 196 23 570 A1, the content of said document hereby being incorporated by reference into the subject matter of the present disclosure.

In the case of the switch shown in FIG. 1, firstly a central region of the cover part 12 and secondly a region on the flanged edge 14 are used as connecting surfaces 22 and 23.

Figure 2:
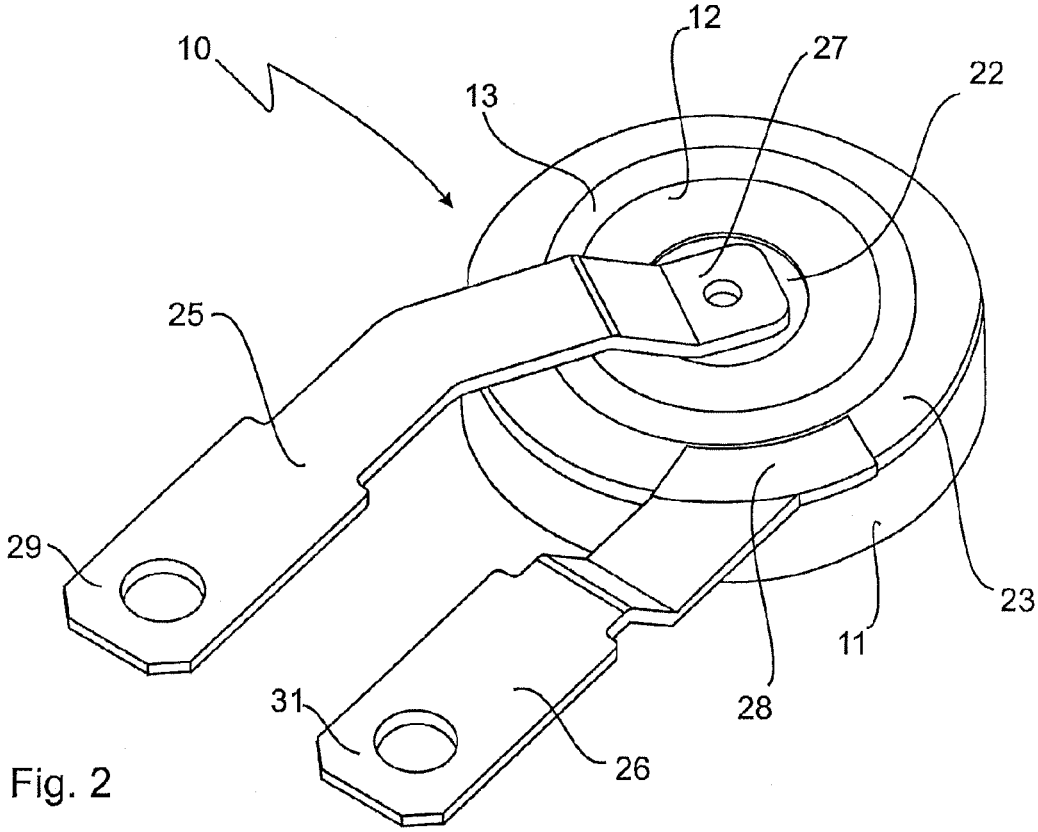

In each case one connecting lug 25, 26 with its respective inner end 27, 28 is now soldered to these connecting surfaces 22, 23, as can be seen from FIG. 2, which shows a perspective view at an angle from above of a temperature-dependent switch 10 which has any desired internal design and has the soldered-on connecting lugs 25, 26.

The connecting lugs 25, 26 are in the form of a plug-type connection at their respective free ends 29, 31, with the result that they can be connected directly, quickly and reliably to the appliance to be protected by means of being screwed, by suitable clamping techniques or by being plugged on.

Figure 3:
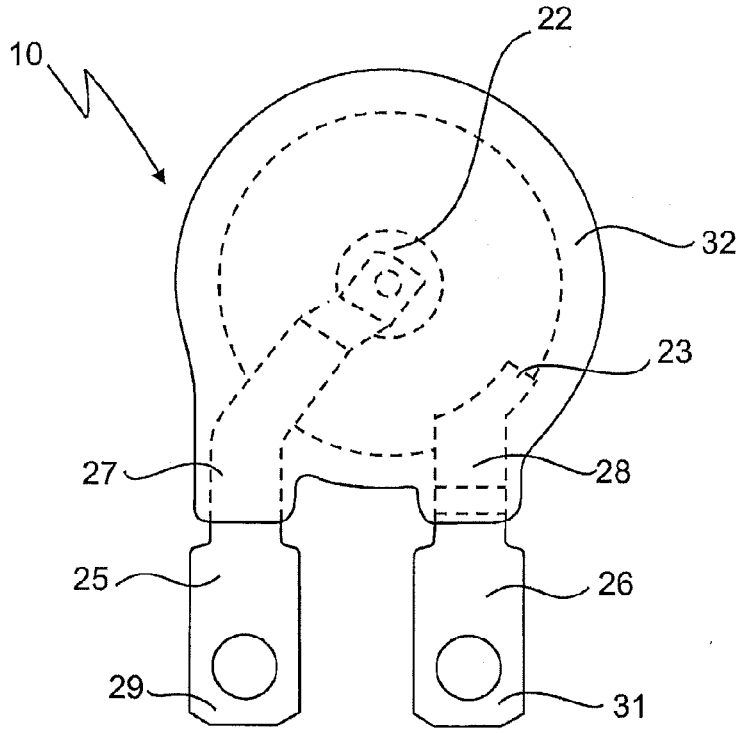
FIG. 3 shows a plan view of the switch shown in FIG. 2, but with an insulating protective layer around the housing and the inner ends of the connecting lugs.

As has already been mentioned, the lower part 11 and the cover part 12 of the switch 10 are manufactured from electrically conducting material, with the result that the switch 10 needs to be insulated from the outside prior to being enclosed on or in an electrical appliance to be protected, for which purpose said switch has been surrounded by an insulating protective layer 32, as can be seen in the plan view shown in FIG. 3.

This insulating protective layer 32 is configured in terms of its material constitution in such a way that it brings about a structurally stable connection between the lower part 11 and the cover part 12, the connecting surfaces 22 and 23 and the inner ends 27 and 28 of the connecting lugs 25 and 26, respectively. In addition, it is designed such that the free ends 29 and 31 of the connecting lugs 25 and 26, respectively, remain free of the protective layer 32.

The protective layer 32 therefore performs two functions. Firstly, it ensures the electrical insulation of the switch 10 and also ensures that it is not possible for any dirt to enter the interior of the housing formed from the lower part 11 and the cover part 12.

Furthermore, the protective layer 32 also ensures, however, that the connecting lugs 25, 26 are held and fixed so securely and fixedly on the housing that the electrical connections between the connecting surfaces 22, 23 and the inner ends 27, 28 of the connecting lugs 25, 26 do not become fragile when the finished switch 10 is subsequently fitted, even if, in the process, they are subject to greater mechanical loads as the result of the plug-type assembly than is the case for strand wire connections.

In order to ensure that this is the case, in the embodiment shown, the protective layer 32 is produced as a sintered protective layer 32 by means of liquid-phase sintering with a thermosetting plastic in the form of an epoxy resin.

Figure 4:
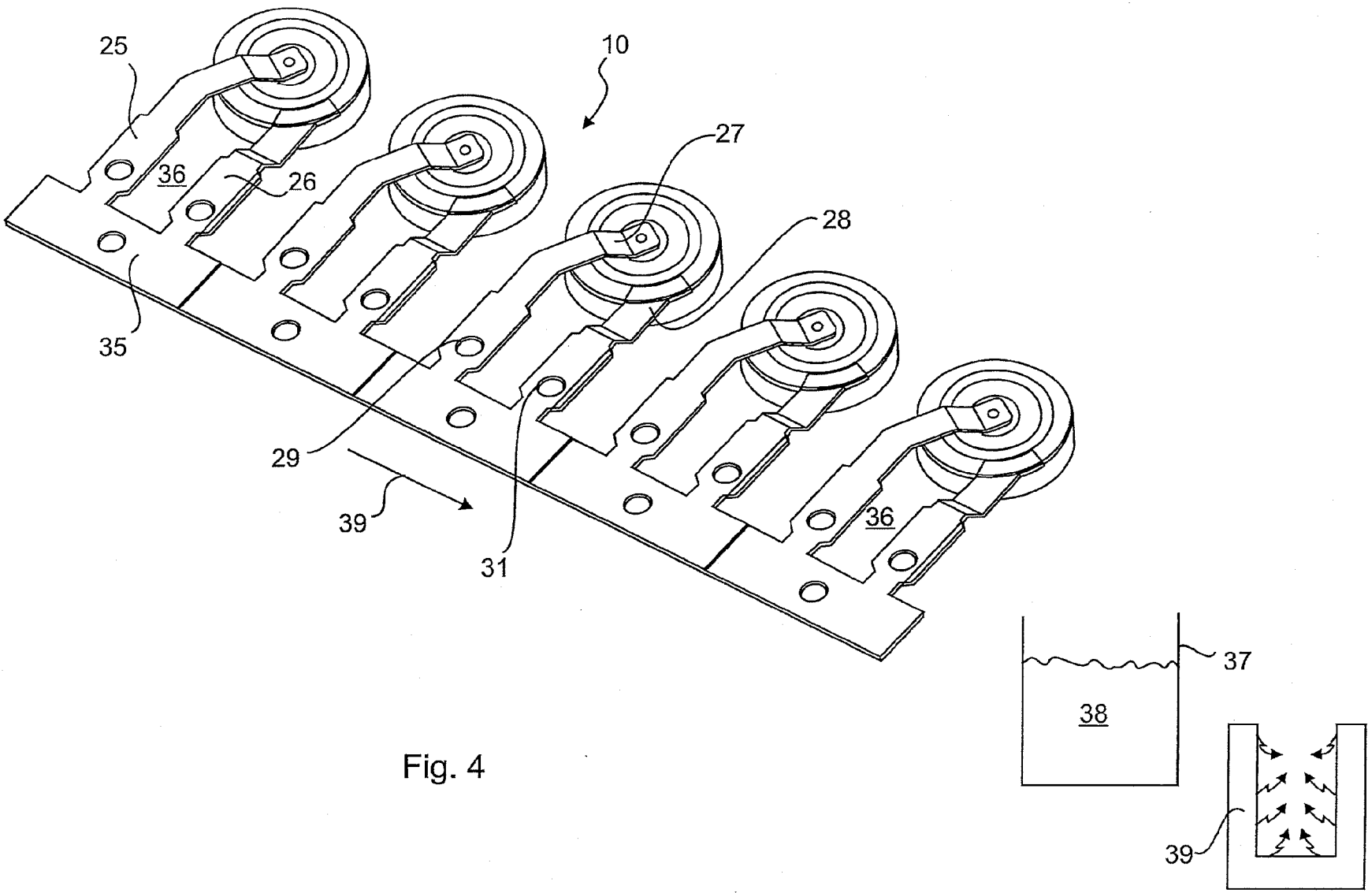
FIG. 4 shows a plan view of connecting lug pairs, which have been stamped from the strip, but are still located on the strip, wherein temperature-dependent switches have already been soldered on and are subsequently immersed in a bath (shown schematically) with sintering epoxy solution.

In this regard, FIG. 4 shows a process for manufacturing the switch 10 shown in FIG. 3. For this purpose, pairs 36 of connecting lugs 25, 26 are stamped out on a strip 35, with one end still being connected to the strip 35, but the other end already having been soldered to the temperature-dependent switches 10.

In the case of "on-strip" production of the temperature-dependent switches, first the connecting lugs 25, 26 are therefore stamped out in pairs and then bent at their free ends in such a way that they match the connecting surfaces 22, 23 of the temperature-dependent switches 10. These switches 10 are then supplied to the strip 35 in such a way that the connecting lugs 25, 26 can be soldered to the connecting surfaces 22, 23.

Then, the switches 10 are provided with the protective layer 32 in a bath (illustrated schematically at 37) with a sintering epoxy solution 38. The switches 10 which are still located on the strip 35 are guided for this purpose along their transport direction 39 through the bath 37 with the sintering epoxy solution 38 such that the free ends 29, 31 are not immersed in the sintering epoxy solution 38.

Once they have been passed through the bath 37, the switches 10 are guided through a continuous furnace (shown at 39) in order to produce a sintered layer. This operation is repeated at least twice, with a continuous furnace 39 following each bath 37. In this way, a protective layer 32 is produced which is so rigid and can be subjected to such mechanical loads that the connecting lugs 25, 26 are held and fixed so securely and fixedly on the housing that the electrical connection between the connecting surfaces 22, 23 and the inner ends 27, 28 of the connecting lugs 25, 26 do not suffer any damage when subsequently handled.

Therefore, what is claimed is:

1. A temperature-dependent switch, comprising:

a housing having an outside, a first and at least a second connecting surface being provided on said outside, at least two feed lines formed as connecting lugs and each having an inner end and an outer free end remote from said inner end, each feed line being directly connected, at its inner end, to a respective connecting surface in material-connecting engagement, and, at its free end projecting from said housing and being directly formed as a plug-type connection, and a temperature-dependent switching mechanism arranged in said housing, which switching mechanism, depending on its temperature, producing a closed or opened electrically conducting connection between the two connecting surfaces, the switch being encased by an electrically insulating protective layer, wherein the feed lines, at their free ends only, are free from the protective layer, and wherein the insulating protective layer comprises a sintered protective layer that is directly applied to and completely encapsulates the inner ends of the connecting lugs and the housing at least in the areas of said first and second connecting surfaces and where the connecting lugs project from the housing so that the inner ends of the connecting lugs are rigidly fixed to the housing by the insulating protective layer, thereby bringing about a structurally stable connection between the housing, the connecting surfaces and the inner ends of the connecting lugs.

2. The switch of claim 1, wherein the inner ends are soldered to the connecting surfaces.

3. The switch of claim 1, wherein the insulating protective layer contains a thermosetting plastic, preferably an epoxy resin.

4. The switch of claim 1, wherein the temperature-dependent switching mechanism comprises a bimetallic part.

5. The switch of claim 4, wherein the bimetallic part is arranged electrically in series between the connecting surfaces when the switch is in the closed state.

6. The switch of claim 4, wherein the temperature-dependent switching mechanism comprises a spring part.

7. The switch of claim 6, wherein the spring part is arranged electrically in series between the connecting surfaces when the switch is in the closed state.

8. The switch of claim 4, wherein the switching mechanism comprises a contact bridge, which is carried by the bimetallic part and is arranged electrically in series between the connecting surfaces when the switch is in the closed state.

9. The switch of claim 6, wherein the switching mechanism comprises a contact bridge, which is carried by the spring part and is arranged electrically in series between the connecting surfaces when the switch is in the closed state.

10. The switch of claim 1, wherein the insulating protective layer substantially completely encases the switch.

11. The switch of claim 10, wherein the insulating protective layer completely encases the switch such that only the free ends of the feed lines are free from the protective layer.

* * * * *